US006789333B2

(12) United States Patent
Nishiwaki et al.

(10) Patent No.: US 6,789,333 B2
(45) Date of Patent: Sep. 14, 2004

(54) MIDSOLE INCLUDING CUSHIONING STRUCTURE

(75) Inventors: Tsuyoshi Nishiwaki, Kobe (JP); Toshikazu Kayano, Kobe (JP); Shigeyuki Mitsui, Kobe (JP)

(73) Assignee: ASICS Corporation, Kobe (JP)

( * ) Notice: Subject to any disclaimer, the term of this patent is extended or adjusted under 35 U.S.C. 154(b) by 0 days.

(21) Appl. No.: 10/132,013

(22) Filed: Apr. 25, 2002

(65) Prior Publication Data

US 2003/0200678 A1 Oct. 30, 2003

(30) Foreign Application Priority Data

May 11, 2001 (JP) ..... 2001-141157

(51) Int. Cl.[7] ..... A43B 13/18; A43B 21/32; A43B 19/00

(52) U.S. Cl. ..... 36/28; 36/30 R; 36/37; 36/71

(58) Field of Search ..... 36/28, 3 B, 29, 36/30 R, 31, 35 R, 37, 35 B, 44, 71

(56) References Cited

U.S. PATENT DOCUMENTS

| | | | | |
|---|---|---|---|---|
| 3,429,545 A | * | 2/1969 | Michel | 36/35 B |
| 4,120,102 A | | 10/1978 | Kenigson | |
| 4,217,907 A | | 8/1980 | Meiller | |
| 4,316,335 A | | 2/1982 | Giese et al. | |
| 4,521,979 A | | 6/1985 | Blaser | |
| 4,624,062 A | | 11/1986 | Autry | |
| 4,680,876 A | * | 7/1987 | Peng | 36/35 B |
| 4,845,863 A | | 7/1989 | Yung-Mao | |
| 4,918,838 A | * | 4/1990 | Chang | 36/28 |
| 5,042,175 A | | 8/1991 | Ronen et al. | |
| 5,044,096 A | | 9/1991 | Polegato | |
| 5,086,574 A | | 2/1992 | Bacchiocchi | |
| 5,092,060 A | | 3/1992 | Frachey et al. | |
| 5,172,494 A | | 12/1992 | Davidson | |
| 5,224,278 A | * | 7/1993 | Jeon | 36/29 |
| 5,233,767 A | | 8/1993 | Kramer | |
| 5,343,639 A | * | 9/1994 | Kilgore et al. | 36/29 |
| 5,369,896 A | | 12/1994 | Frachey et al. | |
| 5,448,839 A | | 9/1995 | Blissett et al. | |
| 5,607,749 A | * | 3/1997 | Strumor | 36/28 |
| 5,611,152 A | | 3/1997 | Richard et al. | |
| 5,625,965 A | | 5/1997 | Blissett et al. | |
| D392,451 S | | 3/1998 | Collins et al. | |
| 5,782,014 A | | 7/1998 | Peterson | |
| 5,832,634 A | | 11/1998 | Wong | |
| D405,592 S | | 2/1999 | Strawser et al. | |
| 5,987,781 A | | 11/1999 | Pavesi et al. | |
| 5,992,052 A | | 11/1999 | Moretti | |
| 6,007,503 A | | 12/1999 | Berger et al. | |
| 6,035,559 A | | 3/2000 | Freed et al. | |
| 6,041,521 A | | 3/2000 | Wong | |
| 6,041,522 A | | 3/2000 | Anteby | |

(List continued on next page.)

FOREIGN PATENT DOCUMENTS

| | | |
|---|---|---|
| JP | 55-47804 | 4/1980 |
| JP | 61-021436 | 1/1986 |
| JP | 03170102 | 7/1991 |
| JP | 03-170104 | 7/1991 |
| JP | 08-038211 | 2/1996 |
| JP | 11-113605 | 4/1999 |
| JP | 20001197503 A | 7/2000 |

*Primary Examiner*—Anthony Stashick
(74) *Attorney, Agent, or Firm*—Michael E. Zall

(57) ABSTRACT

A midsole includes a thick plate-shaped or column-shaped cushioning portion. A plurality of grooves is formed on an outer peripheral surface of the cushioning portion. The respective grooves are helically formed around a substantially vertical line. The respective grooves are arranged substantially parallel with each other. A range $\alpha$ in which each of the grooves is formed is larger than a range of 15 degrees around the axial line and is smaller than a range of 180 degrees around the axial line.

7 Claims, 16 Drawing Sheets

U.S. PATENT DOCUMENTS

| | | | | | |
|---|---|---|---|---|---|
| D424,289 | S | | 5/2000 | Sorofman | |
| D432,770 | S | | 10/2000 | Breault | |
| 6,125,557 | A | | 10/2000 | Brown | |
| 6,131,310 | A | | 10/2000 | Fang | |
| 6,161,315 | A | | 12/2000 | Dalton | |
| 6,205,684 | B1 | | 3/2001 | Snyder | |
| 6,234,987 | B1 | | 5/2001 | Chen | |
| 6,269,555 | B1 | | 8/2001 | Brown | |
| D447,852 | S | | 9/2001 | Schroeder | |
| 6,282,816 | B1 | | 9/2001 | Rosendahl | |
| 6,487,796 | B1 | * | 12/2002 | Avar et al. | 36/28 |
| 2001/0049888 | A1 | * | 12/2001 | Krafsur et al. | 36/28 |

* cited by examiner

FIG.5(a)
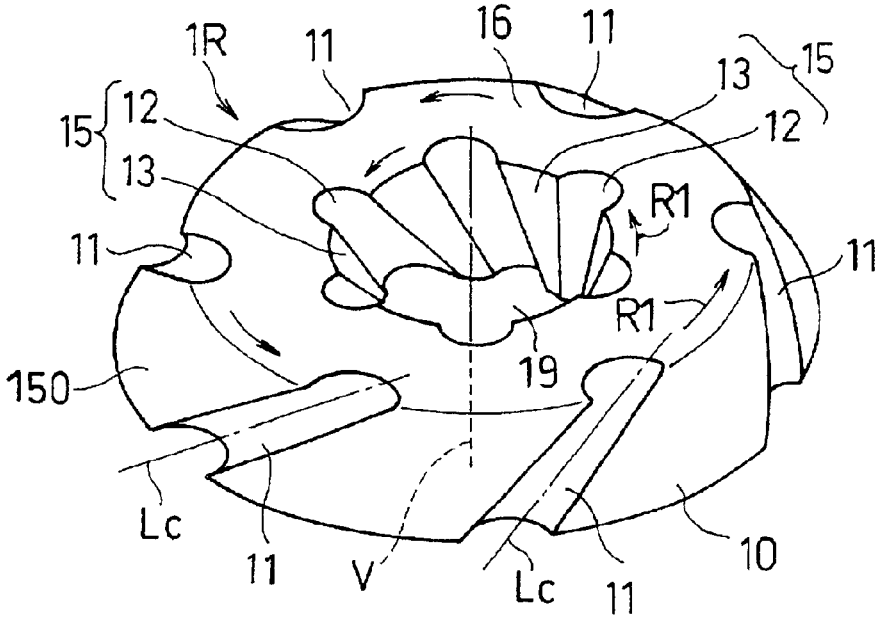
FIG.5(b)
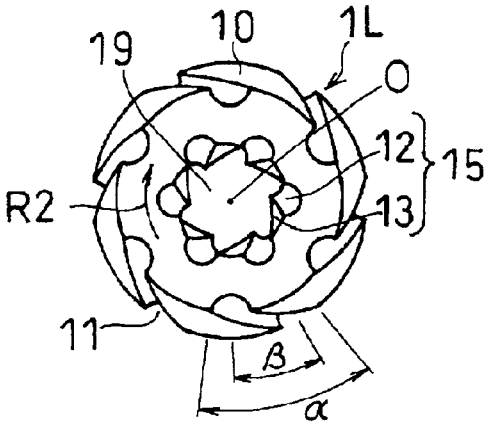
FIG.5(d)
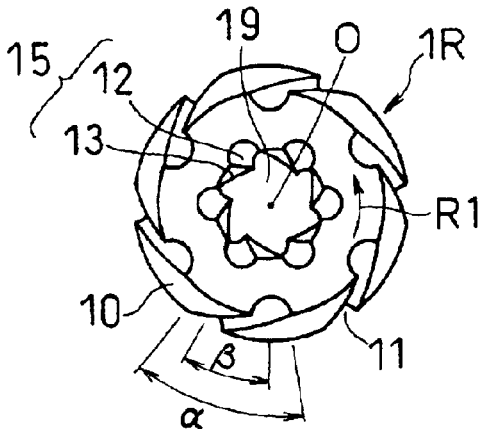
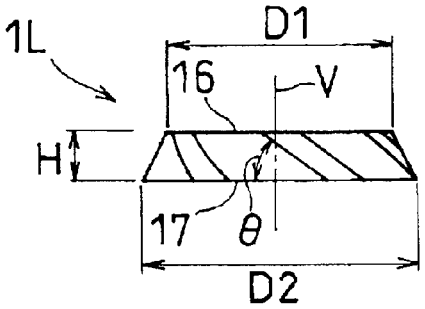
FIG. 5(c)
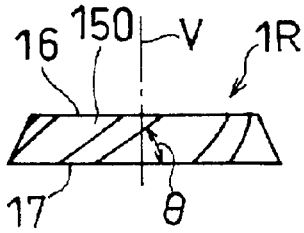
FIG. 5(e)

MIDSOLE INCLUDING CUSHIONING STRUCTURE

BACKGROUND OF THE INVENTION

1. Field of the Invention

The present invention relates to a midsole of a shoe sole, particularly to a cushioning structure thereof.

2. Description of the Related Art

A shoe sole is required to have cushioning performance.

In a conventional shoe sole, in general, a landing shock at the time of walking is absorbed by dissipating energy through compression deformation of a midsole or the like. However, a sufficient cushioning property can not be obtained merely by the absorption (dissipation) of the energy through compression deformation, since the amount of the absorption is generally small.

On the other hand, if the midsole is made thick in order to make the dissipation of the energy large, the lightweight property of the shoe sole is lost.

FIG. 15 (*a*) is a perspective view of a cushioning part disclosed in Japanese Patent Laid-Open No. Hei8-38211.

This cushioning part 500 is made of gel, and is provided with notch portions 501 for allowing compression deformation at the time of compression deformation of the part 500. However, the notch portions 501 are not a significant factor in promoting shear deformation.

FIG. 15(*b*) is a cross-sectional vertical side view showing a cushioning structure disclosed in Japanese Patent Laid-Open No. Hei3-170102.

The cushioning structure shown in FIG. 15(*b*) is provided with a columnar part 510 made of gel, and a coil spring 511 fitted around the part 510 for storing repulsive "spring-back" energy at the time of kicking and going forward.

FIG. 15(*c*) is a perspective view showing a part of an orthopedic shoe sole disclosed in U.S. Pat. No. 4,217,907.

This part 520 is fixed to a heel of an outer sole. This part 520 includes a number of projecting ribs 521 arranged side by side in a circumferential direction. When receiving a repulsing force W from the ground, the projecting ribs 521 rotate part 520 in the direction of the arrow 522. The part 520 is for correcting and curing foot deformities by this rotation. Part 520 is made of a relatively hard material and is not designed to absorb shock.

FIG. 16(*a*) and FIG. 16(*b*) are a front view and a plan view respectively showing a projection 400 of a sole disclosed in Peterson (U.S. Pat. No. 5,782,014).

A midsole unit of Peterson is provided with the helical or screw-like projection 400. Groove 401 is provided around the projection 400 in a range $\alpha 1$ of rotation of 360 degrees or more, i.e., groove 401 completely circumscribes projection 400. Since projection 400 thus has a shape like a screw and if a compression load is applied vertically to projection 400, the projection 400 is vertically compression-deformed like a coil spring, i.e., there is only a minimal amount of shear deformation.

A cushioning structure disclosed in Japanese Patent Laid-Open No. 197503/2000 that includes a shearing transformation element at a rear foot portion of a midsole. The shearing transformation element is shear-deformed at the time of landing in such a manner that it falls forward. However, since the element is deformed in such a manner that it falls, it is difficult to apply this concept under the ball of the foot.

SUMMARY OF THE INVENTION

An object of the invention is to improve a cushioning property due to shear deformation by providing a new structure of a shoe sole.

In order to achieve the object, according to a first aspect of the invention, a midsole is provided between an outer sole and an upper that is suitable for absorbing a shock of landing that includes a thick plate-shaped or column-shaped cushioning portion. A plurality of grooves are formed on an outer peripheral surface of the cushioning portion. The respective grooves are helically formed around a substantially vertical axial line. The respective grooves are arranged substantially parallel with each other. A range $\alpha$ in which each of the grooves is formed is larger than about 15 degrees around the axial line and smaller than about 180 degrees around the axial line.

When compression load is applied to the cushioning portion in the vertical direction, a rotating force to twist the cushioning portion around the vertical axial line is applied to the cushioning portion. Thus, shear deformation along the horizontal plane perpendicular to the axial line is generated in the inside of the cushioning portion.

This shear deformation has a cushioning function (i.e. an absorption function of energy) much greater than normal compression deformation. In the case where the cushioning part is required to be thin, e.g., the ball of the foot, the cushioning function due to shear deformation is greater and more effective than the cushioning function created by compression thereon. Further, since this shear deformation is generated around the axial line, in the case where the cushioning part is provided at a thin place, it has the cushioning function greater than such shear deformation as causes deformation in a state of falling, and therefore, it is more effective.

In the invention, the "midsole" is provided between an outer sole and an upper and has the cushioning function. The whole midsole may be integrally formed, or may be constructed by assembling a plurality of parts. Besides, the cushioning portion may be integrally formed with a midsole body, or may be constructed by a part different from the midsole body.

In the invention, the term "helix" denotes a line formed by simultaneously and continuously carrying out both rotation of a point around one axial line and translation thereof along the axial line. The term "helical" means "helix-like", that is, includes not only a case where the ratio of a rotation angle by the rotation to a movement amount by the translation is constant, but also a case where the ratio of the rotation angle to the movement amount is inconstant. Further, the "helical" includes a locus formed by simultaneously carrying out the parallel movement of the translation, which accompanies the rotation, along the axial line, and the movement in a radial direction with respect to the axial line.

In the invention, since the plurality of helical grooves is provided in the cushioning portion or the cushioning part, a helical protrusion or convex portion (bank) is generally formed between the grooves.

In the case where the point is not moved in the radial direction, the groove and the convex portion become such groove and convex portion as those of a helical gear. In the case where the point is moved in the radial direction, in addition to the parallel movement along the axial line, the groove and the convex portion become such groove and convex portion as those of a helical bevel gear or a spiral bevel gear.

In the invention, it is preferable that a lead angle 0 between the groove and the horizontal plane is set within the range of 35 degrees to 60 degrees. In the case where the lead angle $\theta$ is set within the range as stated above, since the projection between the grooves is deformed in such a manner that it largely falls, the cushioning performance becomes high.

According to a second aspect of the invention, a midsole provided between an outer sole and an upper and being suitable for absorbing a shock of landing includes a midsole body and a cushioning part (component).

The midsole body includes a cavity. The cushioning part is fitted in the cavity. The cushioning part is formed of an elastomer. Young modulus of a member constituting the cushioning part is set to be a value smaller than Young modulus of a member constituting the midsole body. The cushioning part includes a through hole passing through the cushioning part from its upper surface to its lower surface, so that it is formed into a ring shape having an outer peripheral surface and an inner peripheral surface. A plurality of grooves is helically provided on the outer peripheral surface of the cushioning part, the grooves being arranged substantially parallel with each other. A plurality of grooves is helically provided on the inner peripheral surface of the part, the grooves being arranged substantially parallel with each other.

In the second aspect, since the through hole is formed in the cushioning part, torsional rigidity around the axial line is small, and therefore, in the case where a rotating force is generated in the cushioning part, the amount of rotation of the cushioning part becomes large. Besides, the grooves are formed not only on the outer peripheral surface of the cushioning part, but also on the inner peripheral surface of the cushioning part. Accordingly, the rotating force generated in the cushioning part becomes high. As stated above, since the cushioning part is easily rotated, and the rotating force becomes high, the cushioning function of the cushioning part is remarkably improved.

In the invention, it is preferable that the "cavity" is generally made a closed space. As the structure of the "cavity", in addition to a case where the closed space is formed in the midsole itself, there is also a case where a recess provided in the midsole is closed by an insole such as a cup insole to form the cavity. In the case where the cushioning part is housed in a sealed container made of soft resin, the cavity may be a space having an opening. Incidentally, the cushioning part may be constructed by sealing a liquid gel in the sealed container.

In the invention, as the material of the "cushioning part", elastomer is used, and preferably a gel such as a silicone gel or a polyethylene gel is used. Besides, it is preferable that the hardness of the cushioning part is SRIS-C hardness (a value measured by a C-type hardness meter of Society of Rubber Industry, Japan Standard) of 35 degrees or less, and more preferably, it is set within the range of SRIS-C hardness of 10 degrees to 30 degrees.

The body portion of the midsole is formed of a foam of resin such as EVA (ethylene-vinyl acetate copolymer) or syndiotactic 1,2-polybutadiene, or a foam of rubber.

In general, it is preferable that the hardness of the cushioning part is set to be a value lower than the hardness of the midsole body by SRIS-C hardness of 2 degrees or larger.

Incidentally, although the hardness value is based on the SRIS-C hardness, a hardness value according to another measuring method can also be converted on the basis of a conversion reference value.

In the second aspect, in a case where the cushioning part is buried in the forefoot portion of the midsole or the rear foot portion, the shape of the cushioning part is set to be a thick plate shape having a thickness of 3 mm or more, a thick plate shape having a thickness of 5 mm or more, or a column shape having a low height as compared with a diameter. Incidentally, as long as a space is secured, the shape of the cushioning part may be a column shape having a high height as compared with a diameter, and may be, for example, a rectangular column shape in addition to a cylindrical shape or a taper cylindrical shape.

In the case where several (five or six) grooves and/or convex portions are provided substantially on the entire periphery of the outer peripheral surface of the cushioning part having the low height as compared with the diameter, the cushioning part becomes the shape like a helical gear.

Incidentally, in order to obtain large deformation by giving continuity to the shear deformation along the peripheral surface, it is preferable that the outer peripheral surface and the inner peripheral surface are made circumferential surfaces (cylindrical surfaces). Besides, it is preferable to form the grooves and the convex portions substantially on the entire periphery and continuously from the upper end of the part to the lower end.

In order to generate sufficiently large shear deformation in the cushioning part, in general, it is preferable to make the width of the convex portion wider than that of the groove, and in order that the cushioning part is deformed integrally with the convex portion, it is preferable that the convex portion is integral with the cushioning part.

According to a third aspect of the invention, a midsole provided between an outer sole and an upper and being suitable for absorbing a shock of landing includes a midsole body and a cushioning part.

The midsole body includes a cavity. The cushioning part is fitted in the cavity. The cushioning part is formed of elastomer. Young modulus of a member constituting the cushioning part is set to be a value smaller than Young modulus of a member constituting the midsole body. The cushioning part is formed to be a plate having an upper surface and a lower surface. A plurality of helical grooves and/or convex portions is formed on at least one of the upper surface and the lower surface of the cushioning part, and the thickness of the cushioning part at the groove and/or convex portion is gradually changed along the groove and/or convex portion.

In the third aspect, since the helical grooves and convex portions are provided on the upper surface or the lower surface of the cushioning part, the ratio of the movement of a helix point in the radial direction becomes remarkably larger than the ratio of the movement in the axial direction. Accordingly, the groove and the convex portion is turbinate.

According to a fourth aspect of the invention, a midsole provided between an outer sole and an upper and being suitable for absorbing a shock of landing includes a midsole body and a cushioning part.

The midsole body includes a cavity. The cushioning part is fitted in the cavity. The cushioning part is formed of elastomer. Young modulus of a member constituting the part is set to be a value smaller than Young modulus of a member constituting the midsole body. The cushioning part includes an upper surface and a lower surface. The midsole body includes a support surface for supporting the lower surface of the cushioning part in the cavity. A plurality of helical convex portions biting into the lower surface of the cushioning part, and/or a plurality of helical grooves into which part of the lower surface of the cushioning part is deformed to be embedded are/is formed on the support surface. When compression load is applied to the cushioning part in the vertical direction, the convex portions and/or grooves generate a rotating force to twist the cushioning part around an axial line substantially along a vertical line.

That is, in the fourth aspect, instead of forming the grooves and the convex portions in the cushioning part, they are formed on the surface of the cavity in the midsole body.

In the case where the cushioning part is molded from low hardness elastomer such as silicone gel, the molding becomes easier when the grooves and the convex portions are provided in the midsole body made of EVA or the like, rather than provided on the cushioning part.

Particularly, when the cushioning part is made flat plate-shaped, the cushioning part can be formed by merely punching a large flat plate by a cutting die such as a Thomson Diecut.

Incidentally, by combining the third and fourth aspects, the grooves and the convex portions may be provided on both the surface of the cavity in the midsole body and the cushioning part.

The invention would be more clearly understood from the following description of the preferred embodiments with reference to the accompanying drawings. However, the embodiments and the drawings are merely for illustration and description. The scope of the invention should be determined on the basis of claims. In the accompanying drawings, the same reference numerals in the plural drawings designate the same or like portions.

BRIEF DESCRIPTION OF THE DRAWINGS

FIG. 5(*a*) is a perspective view of a cushioning part for a right foot, FIG. 5(*b*) is a plan view of a cushioning part for a left foot, FIG. 5(*c*) is a front view of the cushioning part for the left foot, FIG. 5(*d*) is a plan view of the cushioning part for the right foot, and FIG. 5(*e*) is a front view of the cushioning part for the right foot.

DESCRIPTION OF THE EMBODIMENTS

Hereinafter, embodiments of the invention will be described with reference to the drawings.

First Embodiment

FIGS. 1 to 5(*e*) show a first embodiment.

Figure 1:
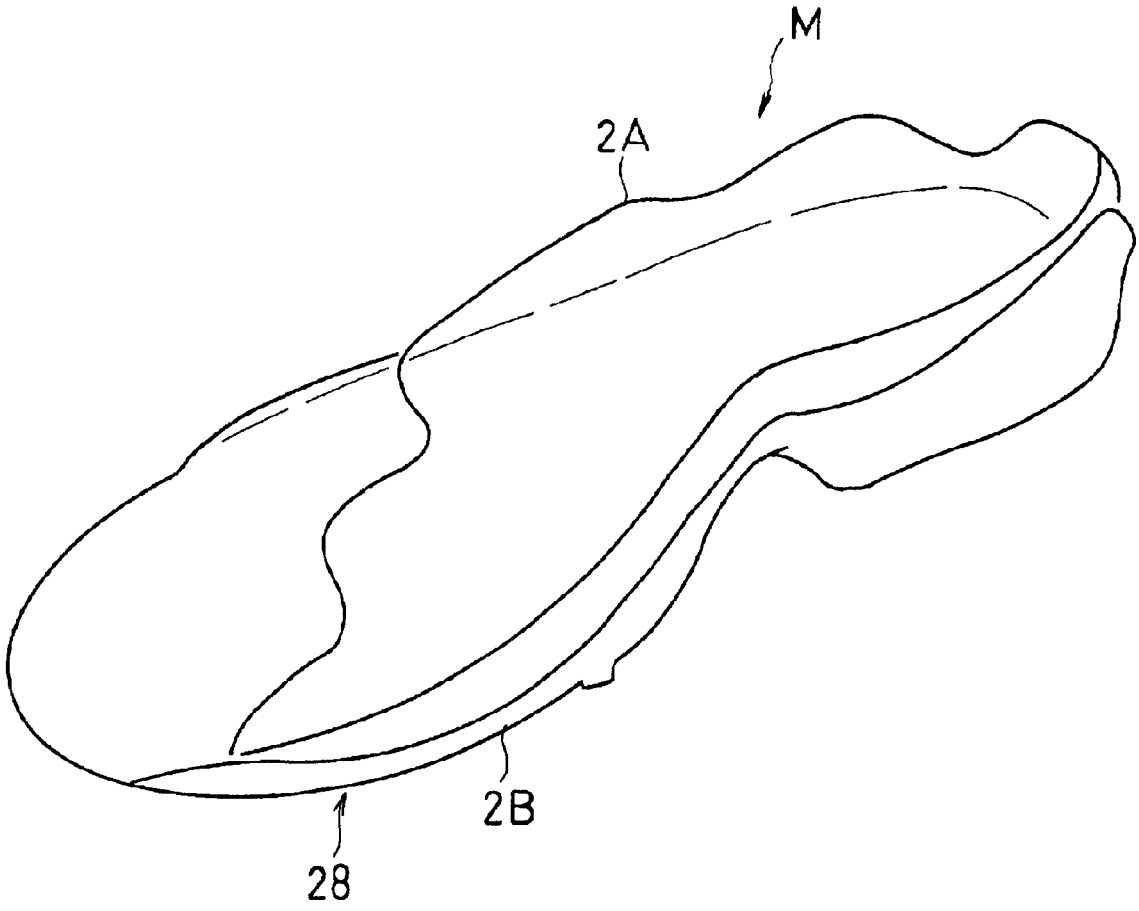
FIG. 1 is a perspective view showing a midsole for a right foot according to a first embodiment of the invention.
Figure 2:
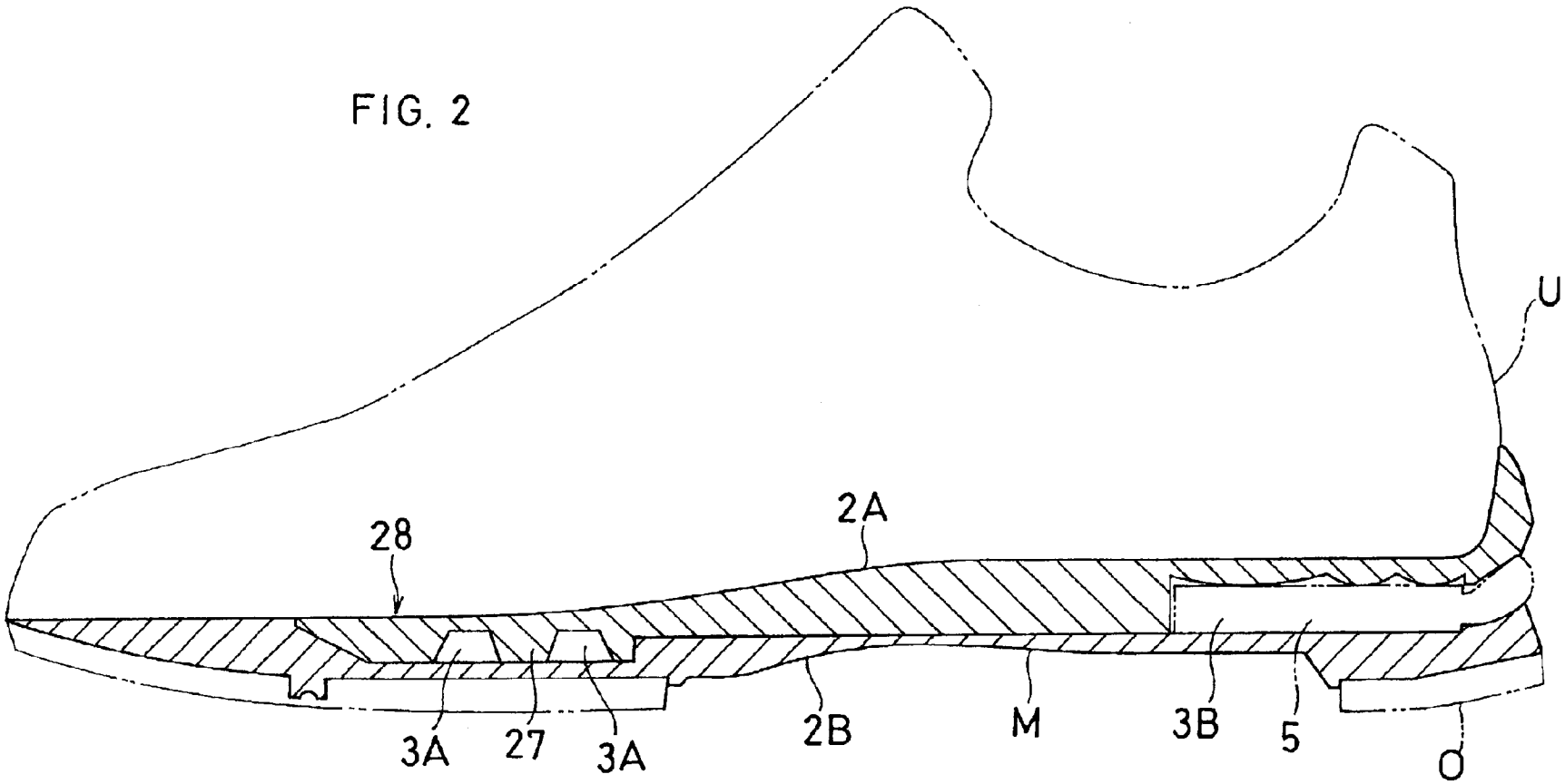
FIG. 2 is a vertical sectional view of the same.

As shown in FIG. 1 and FIG. 2, a first midsole body 2A which is arranged in an upside and a second midsole body 2B which is arranged in a downside are vertically bonded to form a midsole M. An outer sole O, a shank and the like are bonded to the lower surface of the second midsole body 2B. On the other hand, an insole is bonded onto the first midsole body 2A. The midsole body is formed of, for example, EVA. Incidentally, an upper U suitable for wrapping an instep is arranged over the insole. The outer sole O comes in contact with a road surface or a floor surface, and is formed of a material having higher abrasion resistance than the midsole M.

Figure 3:
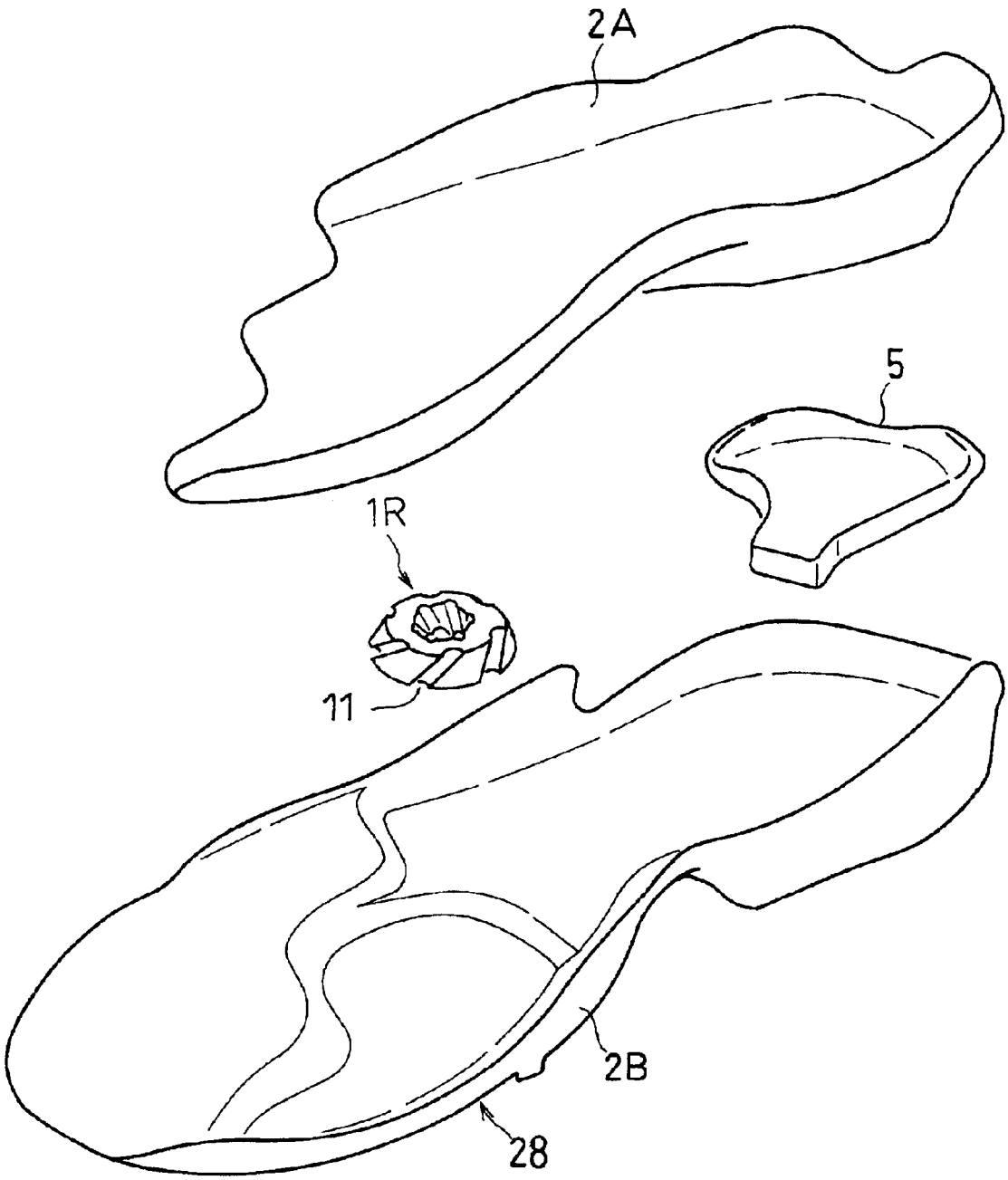
FIG. 3 is an exploded perspective view of the same.
Figure 4:
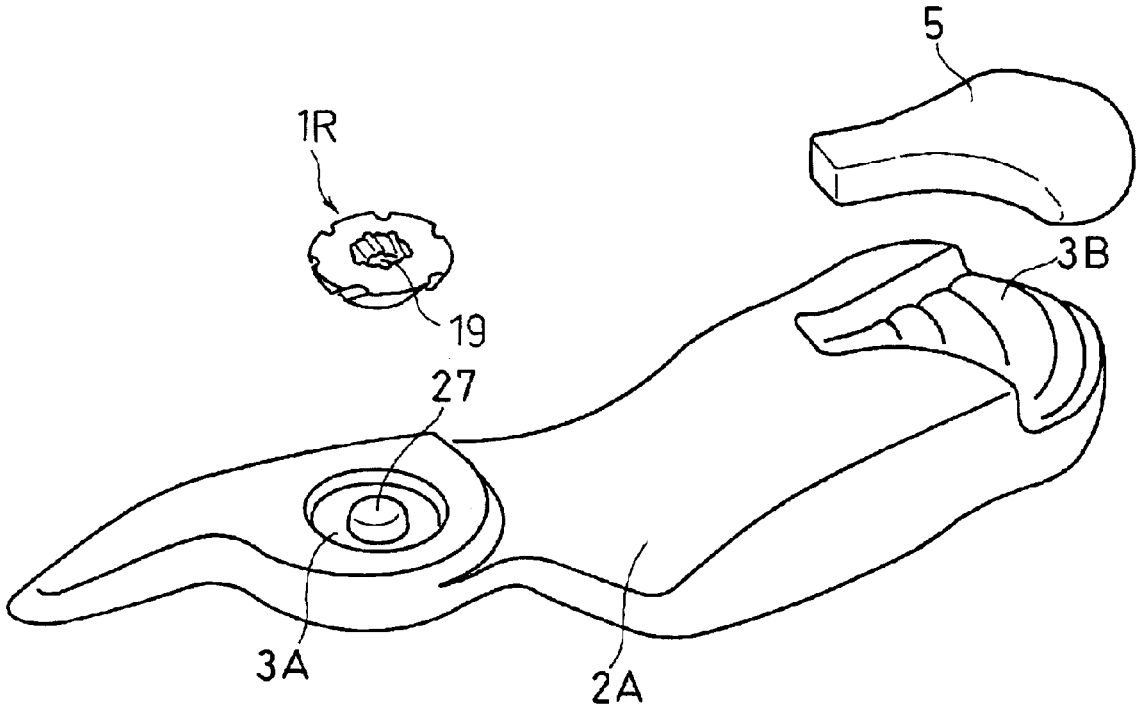
FIG. 4 is an exploded perspective view in which a first midsole body, a cushioning part, and a cushioning unit of FIG. 3 are seen from the bottom.
Figure 6A:
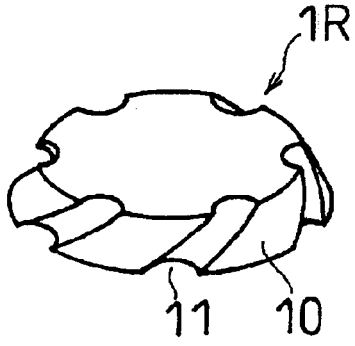
FIGS. 6(*a*) to 6(*d*) are perspective views respectively showing modified examples of the cushioning part.
Figure 6B:
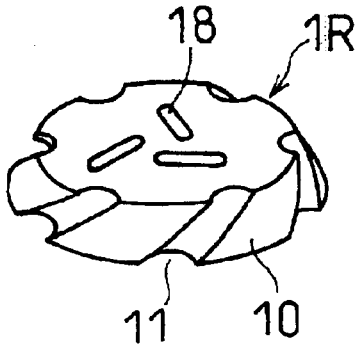
Figure 6C:
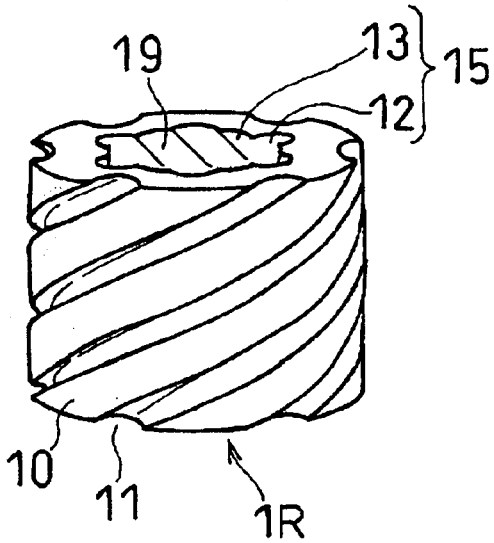
Figure 6D:
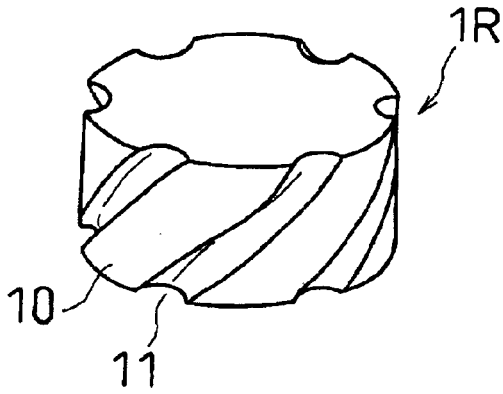

As shown in FIG. 2, first and second cavities 3A and 3B are formed between the first and second midsole bodies 2A and 2B. Referring to FIG. 3, a cushioning part (an example of a cushioning portion) 1R and a cushioning unit 5 are fitted in the first and second cavities 3A, 3B, respectively. As shown in FIG. 4, the respective cavities 3A and 3B are formed by closing recesses formed on the lower surface of the first midsole body 2A by the upper surface of the second midsole body 2B of FIG. 2. Incidentally, the second cavity 3B opens toward the rear.

The first cavity 3A and the cushioning part 1R of FIGS. 2 and 3 are provided at a position corresponding to the ball of the foot (condyle of metatarsal bone of first toe) of the tread portion 28. On the other hand, the cushioning unit 5 is provided at a position corresponding to a portion of the heel near the lateral side.

FIG. 5(*a*), FIG. 5(*d*), and FIG. 5(*e*) show a cushioning part 1R fitted to the right foot midsole. On the other hand, FIG. 5(*b*), and FIG. 5(*c*) show a cushioning part 1L fitted to a left foot midsole (not shown).

The cushioning parts 1L and 1R are made of, for example, silicone gel softer than the midsole bodies 2A and 2B. The cushioning part 1L, 1R has a columnar shape having large outer diameters D1 and D2 as compared with the height (thickness) H and is formed into a ring shape in this embodiment. Referring to FIG. 4, a hollow portion 19 in the central portion of the cushioning part 1L, 1R, mates with a protrusion 27 formed on the first midsole body 2A.

In FIGS. 5(*a*) to 5(*e*), an outer peripheral surface 10 of the cushioning part 1L, 1R is formed into a taper shape in which its diameter shortens as the outer peripheral surface 10 ascends. On the other hand, an inner peripheral surface 15 of the cushioning part 1L, 1R is formed into a taper shape in which its diameter shortens as the inner peripheral surface 15 descends.

In the right foot cushioning part 1R of FIGS. 5(*a*), 5(*d*) and 5(*e*), several (for example, four to eight) helical first and second grooves 11 and 12 along the rotating direction of a right-hand screw are formed on the outer peripheral surface 10 and the inner peripheral surface 15, respectively. On the other hand, in the left foot cushioning part 1L of FIGS. 5(*b*) and 5(*c*), several helical first and second grooves 11 and 12 along the rotating direction of a left-hand screw are formed on the outer peripheral surface 10 and the inner peripheral surface 15, respectively. That is, the respective grooves 11 and 12 are obliquely formed so as to rotate around a substantially vertical axial line V as they descend.

The pitch of the second groove 12 formed on the inner peripheral surface 15 is small, and therefore, several helical convex portions 13 are formed on the inner peripheral surface 15 between the second grooves 12 and 12. Incidentally, a lead angle θ between the groove 11, 12 and the horizontal plane is preferably set to 35 degrees to 60 degrees, more preferably to 40 degrees to 50 degrees. In the case of the range as stated above, since a protrusion 150 between the groove 11 and the groove 11 is sufficiently deformed, the cushioning performance is improved.

The respective grooves 11, 12 and the convex portions 13 are provided on substantially the entire peripheries of the outer peripheral surface 10 and the inner peripheral surface 15 of the cushioning part 1L, 1R, and substantially uniformly. Besides, the respective grooves 11, 12 and the convex portions 13 are formed to be continuous from an upper end surface 16 of the cushioning part 1L, 1R to a lower end surface 17.

The range α in which each of the first grooves 11 is formed is set to a value larger than the range of 15 degrees around the axial line V and smaller than the range of 90 degrees around the axial line V In this case, in general, a rotating angle β from one end of a center line Lc of the one groove 11 to the other end is set to about 5 degrees to 60 degrees. The rotating angle β is the angle that the helical line which is the center line Lc of the one groove 11 rotates around the point O from the upper end of the groove 11 to the lower end of the groove 11.

In FIG. 3, the cushioning unit 5 is formed in such a manner that silicone gel is sealed in a soft resin container, and further, the container is molded integrally with urethane foam.

Next, a mechanism for absorbing a shock will be described.

Referring FIGS. 1 through 5, at the time of walking or running, a foot lands on the ground from a heel, and thereafter, lands on the ground with the tread portion (forefoot portion) 28. When landing with the tread portion 28, the first and second midsole bodies 2A and 2B and the cushioning parts 1L and 1R are compression deformed by the compression load in the vertical direction.

When the compression load is applied to the cushioning part 1R of FIG. 5(*a*), the outer peripheral portion and the inner peripheral portion of the cushioning part 1R are rotated in a circumferential direction R1 and are shear-deformed in such a manner that they fall. That is, when the compression load is applied to the cushioning part 1R, the grooves 11, 12 and the convex portions 13 are deformed in such a manner that they fall, so that the rotating force of twisting them around the vertical axial line V is generated in the cushioning part 1R. In this way, in addition to the compression deformation, the cushioning part 1R is shear-deformed to be twisted along the horizontal plane, so that the great cushioning function is produced.

Particularly, the range a of the groove 11, 12 is set to 15 degrees to 90 degrees (rotation angle β is 5 degrees to 60 degrees). That is, since the cushioning part 1R including the grooves 11 and 12 does not have a shape like a screw, but has a shape like a helical gear (helical bevel gear), when the compression deformation is vertically applied to the part 1R, the part 1R is twisted around the vertical axial line V, and as a result, the shear deformation is generated in the inside of the part 1R.

Incidentally, the right foot cushioning part 1R of FIG. 5(*d*) is twisted in the counter clockwise direction R1, whereas the left foot cushioning part 1L of FIG. 5(*b*) is twisted in the clockwise direction R2.

In this embodiment, the sides of the outer peripheral surface 10 and the inner peripheral surface 15 are formed to be taper-shaped. Thus, the volume of a surface portion to be shear-deformed becomes larger as compared with one having a side which is not taper-shaped. Accordingly, the cushioning function also becomes higher.

Besides, not only the groove 11 is provided on the outer peripheral surface 10, but also the groove 11, 12 and the convex portion 13 are provided on the inner peripheral surface 15. Further, these grooves 11, 12 and the convex portion 13 are formed so as to rotate the cushioning part 1R in one direction. Accordingly, as compared with one in which a groove or the like is provided only on one peripheral surface, the volume of shear deformation becomes larger.

Besides, in the cushioning parts 1L and 1R, a value of an average diameter D=(D1+D2)/2 of the minimum diameter D1 and the maximum diameter D2 is set to be not lower than a value of the height H. It is preferable that the value of the average diameter D is set to be D≧H, and more preferably, D≧2.5 H.

When the value of the average diameter D is set as stated above, the cushioning parts 1L and 1R become apt to generate the shear deformation, and the cushioning effect can be raised. Besides, the cushioning part 1L, 1R can be provided at the tread portion 28 which is required to be thin.

Incidentally, in the case where the cushioning part having such a shape as is obtained by superposing the truncated cones as shown in FIGS. 11(*d*) and 11(*e*) is formed, an average value of the diameter from the upper end surface 16 to the lower end surface 17 is set to be not lower than the value of the height H.

MODIFIED EXAMPLE

FIGS. 6(*a*) to 6(*d*) show modified examples of the cushioning part 1R or 1L.

As shown in FIG. 6(*a*), the cushioning part 1R is not provided with a hollow portion, but may be formed into a thick disk shape.

As shown in FIG. 6(*b*), a through hole 18 passing through the cushioning part 1R from the upper surface to the lower surface may be provided.

As shown in FIGS. 6(*c*) and 6(*d*), the outer peripheral surface 10 and the inner peripheral surface 15 are not tapered, but may be made cylindrical.

Second Embodiment

Figure 7A:
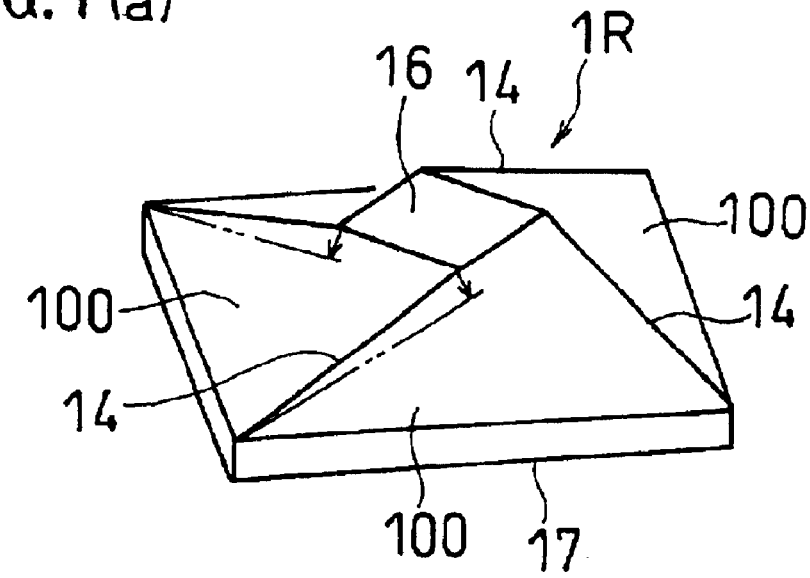
FIG. 7(*a*) is a perspective view showing a cushioning part of a second embodiment, and FIG. 7(*b*) is a perspective view showing another example of the cushioning part.
Figure 7B:
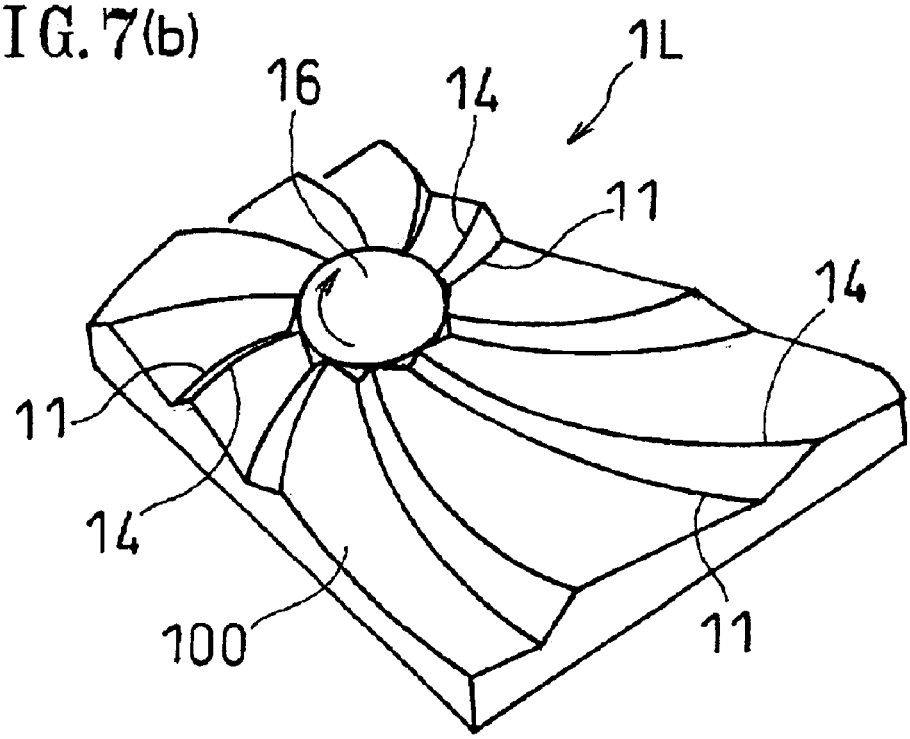

In FIG. 7(*a*), a cushioning part 1R is formed to have a plateau shape (an example of a thick plate) in which its center portion is swollen, and includes a square top portion 16 and a lower surface 17. The cushioning part 1R has an upper surface 100 continuous with the top portion 16. Four convex portions 14 are formed on the upper surface 100. These convex portions 14 are linear, and formed to be helical so that compared with a rotation angle in which a point is rotated around one axial line, the amount of movement of the point along the axial line is indefinite.

Accordingly, when the compression load in the vertical direction is applied to the cushioning part 1R, the convex portions 14 are rotated as indicated by two-dot-chain lines, and generate similar shear deformation to the former embodiment.

In FIG. 7(*b*), a top portion 16, a plurality of grooves 11 and a plurality of convex portions 14 are formed on an upper surface 100 of a thick plate cushioning part 1L. The grooves 11 and the convex portions 14 are radially and turbinately formed. The grooves 11 are made deeper as they approach the periphery of the cushioning part 1L, and accordingly, it can be said that they are helically formed. Therefore, when the compression load is applied to the cushioning part 1L, the cushioning part 1L is twisted in a direction shown by an arrow.

Incidentally, it is preferable that the convex portions 14 are provided to be curved as shown in FIG. 7(*b*).

Incidentally, in a locus of movement of the center of gravity from the landing of a foot to the kicking of the foot, a direction in which a force is applied to the cushioning part subtly varies according to a place of the foot. Thus, it is preferable that the directions of the grooves and the convex portions are set in accordance with the direction in which the force is applied at every fitting place. For example, in the tread portion during the action of running and walking, it is desirable that as in this embodiment, the groove is set to be clockwise with respect to the left foot, and the groove is set to be counter-clockwise with respect to the right foot.

Besides, with respect to the landing direction or the direction in which the force is applied at the heel portion, there are some different types (over-pronater or over-supinater). It is desirable that the twisting direction of the cushioning part is set to comply with that.

That is, it is preferable that the twisting direction of the cushioning part is suitably set in view of a fitting place, a use of a shoe, a state of an exerciser, and the like.

Third Embodiment

Figure 8A:
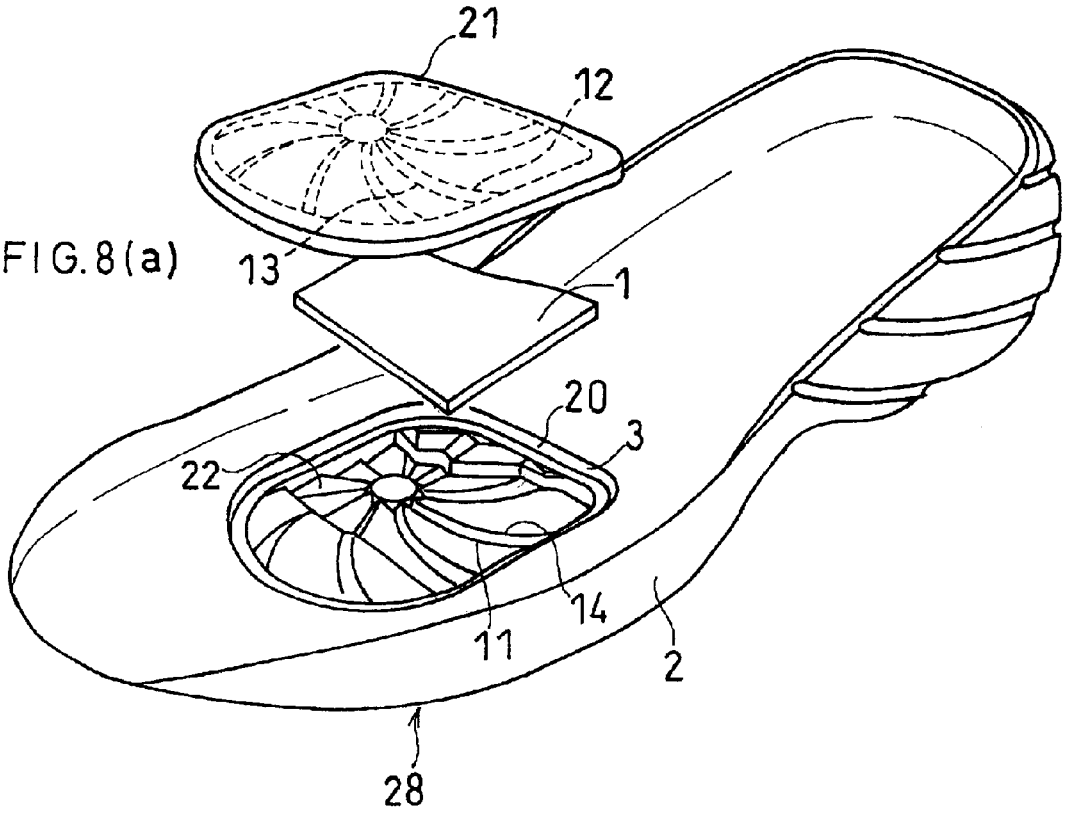
FIG. 8(*a*) is an exploded perspective view showing a midsole of a third embodiment, and FIG. 8(*b*) is a cross-sectional view of the midsole assembled.
Figure 8B:
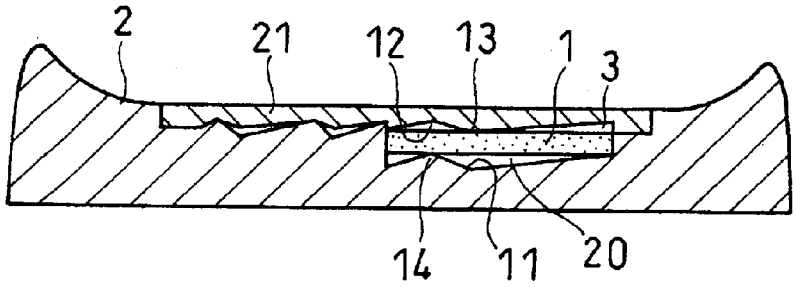
Figure 10:
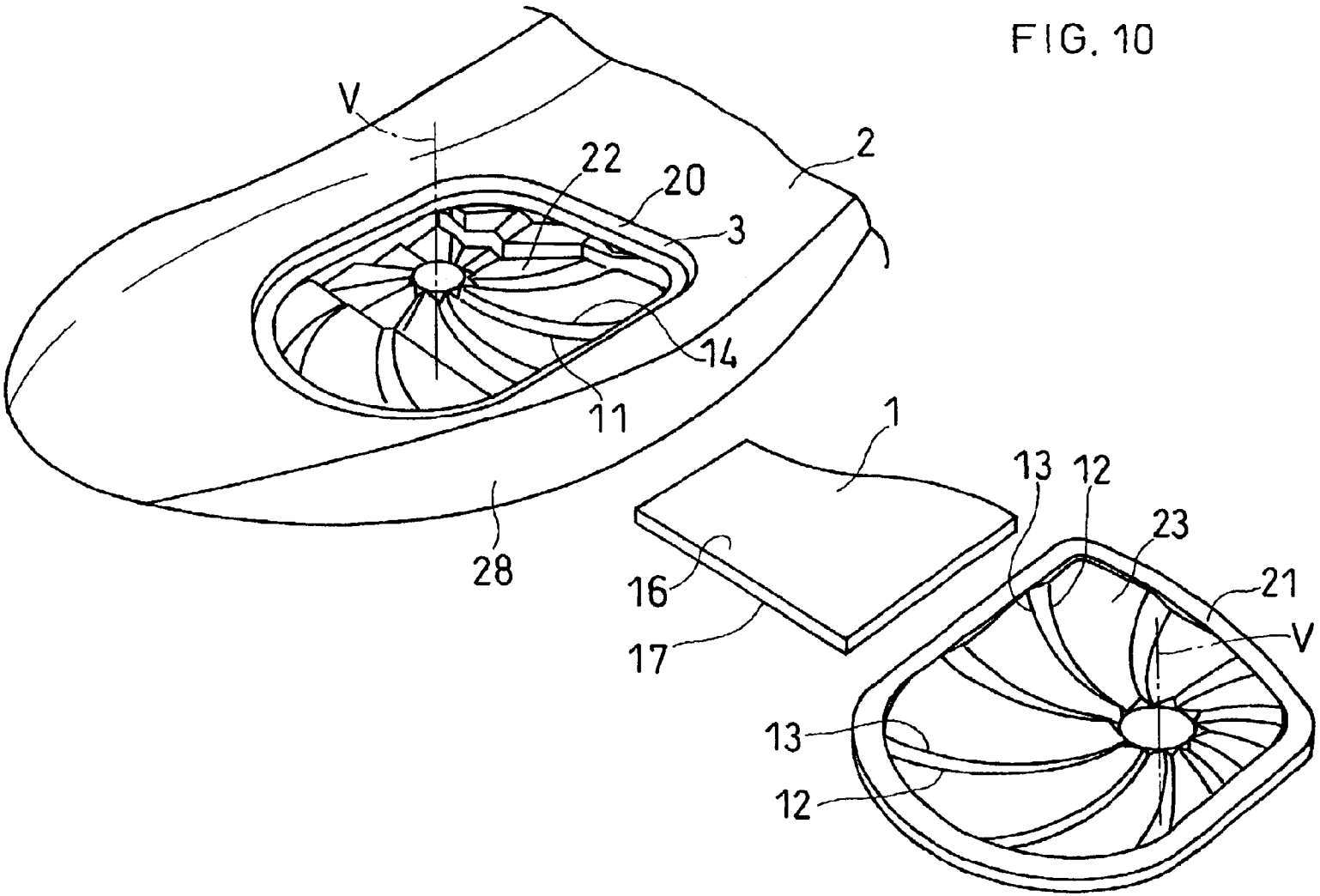
FIG. 10 is a perspective view showing a tread portion of a midsole body, a cushioning part, and a cap.
Figure 11A:
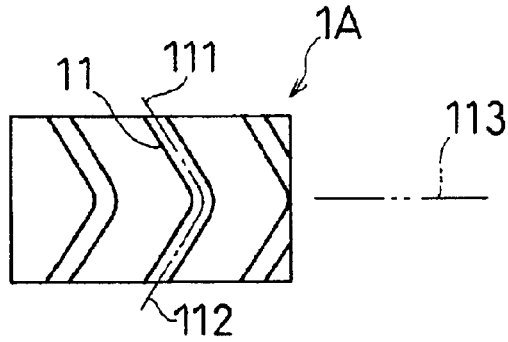
FIG. 11(*a*) is a front view showing a cushioning part of a fourth embodiment, FIG. 11(*b*) is a plan view of the same, FIG. 11(*c*) is a front view showing another example of the cushioning part, and FIGS. 11(*d*) and 11(*e*) are front views respectively showing other examples of the cushioning part.
Figure 11B:
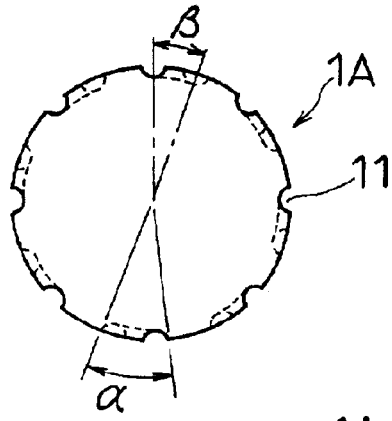
Figure 11C:
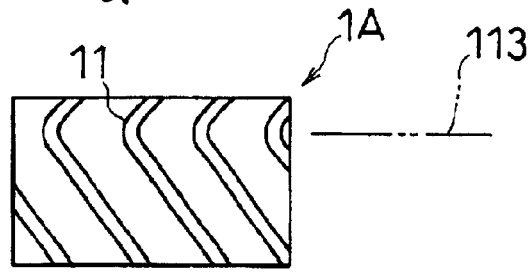
Figure 11D:
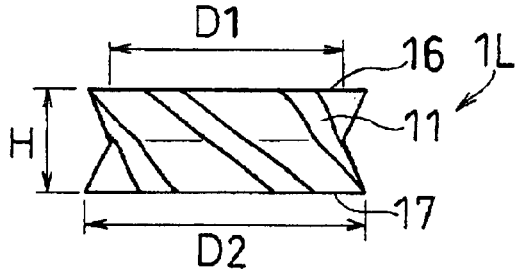
Figure 11E:
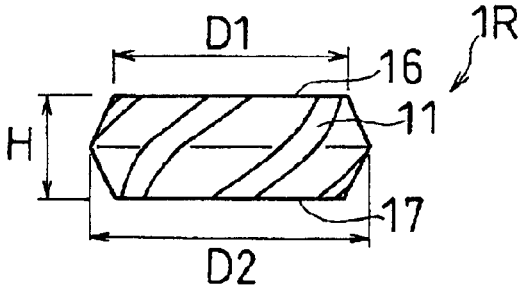

FIG. 8(*a*) to FIG. 10 show a third embodiment.

Figure 9:
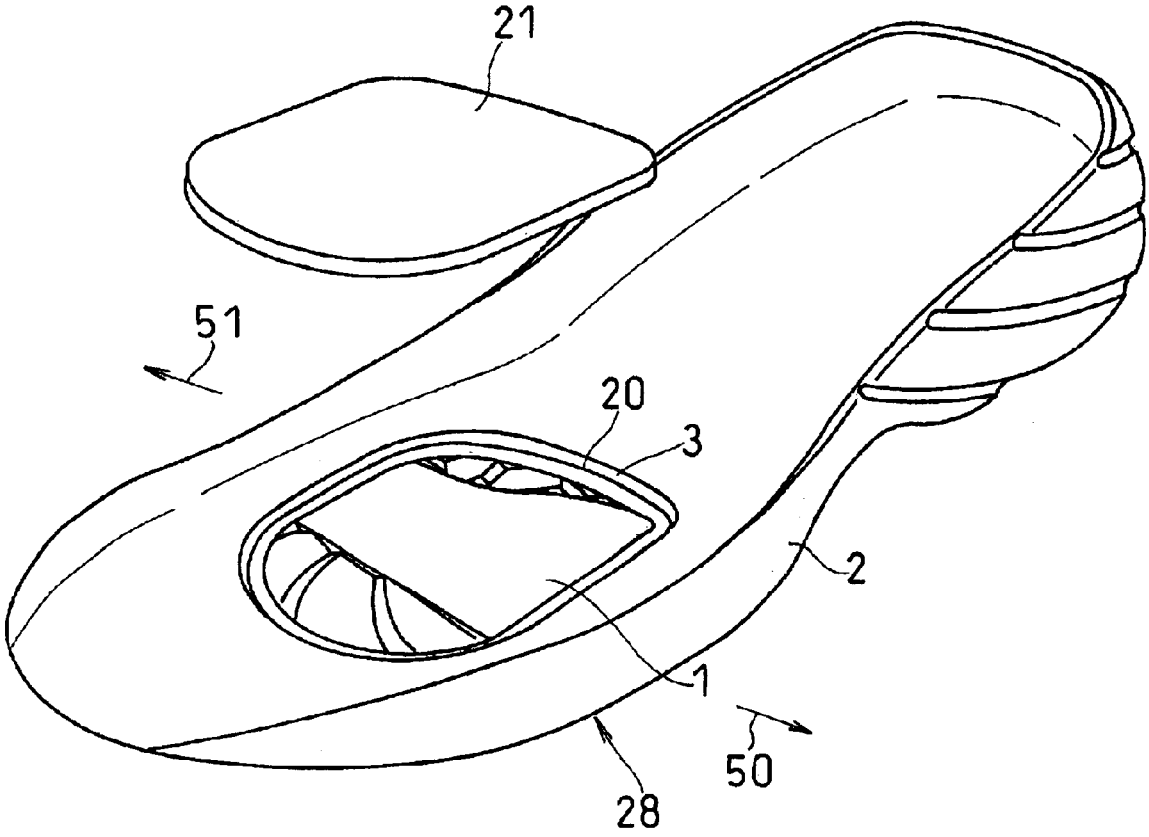
FIG. 9 is an exploded perspective view showing a midsole in a state in which a cushioning part is fitted.

As shown in FIG. 8(*a*), a recess 20 is formed in a tread portion 28 of a midsole body 2. This recess 20 is closed by a cap 21 to constitute a cavity 3 of FIG. 8(*b*). A flat plate cushioning part 1 is fitted in the cavity 3 as shown in FIG. 9.

As shown in FIG. 10, first grooves 11 and first convex portions 14 are formed on an upper surface (support surface of the cavity) 22 of the recess 20 of the midsole body 2. On the other hand, second grooves 12 and second convex portions 13 are formed on a lower surface (surface of the cavity) 23 of the cap 21. A lower surface 17 of the cushioning part 1 is supported by the upper surface 22 of the recess 20, whereas an upper surface 16 of the cushioning part 1 is in contact with the lower surface 23 of the cap 21.

The grooves 11 and 12 and the convex portions 13 and 14 are numerously provided, and are radially and turbinately formed. The respective grooves 11 and 12 are gradually made deeper as they approach the peripheries of the recess 20 and the cap 21, and accordingly, it can be said that they are helically formed.

As is clearly shown in FIG. 8(*a*), the first groove 11 and the convex portion 14, and the second groove 12 and the convex portion 13 are mutually twisted in the same rotating direction. Besides, as shown in FIG. 8(*b*), the second convex portion 13 is arranged to face the first groove 11 via the cushioning part 1. On the other hand, the first convex portion 14 is arranged to face the second groove 12 via the cushioning part 1.

In the shoe sole of this embodiment, when compression load is applied to the tread portion 28, the convex portions 13 and 14 of FIG. 8(*a*) bite into the cushioning part 1, and the cushioning part 1 is deformed to be embedded into the grooves 11 and 12. Thus, the cushioning part 1 of FIG. 10 becomes the shape as shown in FIG. 7(*b*), and when the compression load is applied in this state, the cushioning part 1 is twisted around the vertical axial line V As a result, shearing stress along the horizontal plane (surface) is generated in the cushioning part 1.

Fourth Embodiment

FIG. 11(*a*) and FIG. 11(*b*) show another example of a cushioning part 1A. As shown in FIG. 11(*a*), a groove 11 of the cushioning part 1A is formed to be substantially V-shaped along lines 111 and 112. That is, this groove 11 is formed along a V-shaped line in which the two helixes 111 and 112 different from each other in the rotation direction are smoothly connected at the vertically center position.

In the case of this embodiment, when the compression load is applied to the cushioning part 1A, rotating force is generated in different directions above and below an imaginary surface 113 of the cushioning part 1A.

Incidentally, as shown in FIG. 11(*c*), in the cushioning part 1A, ranges $\alpha$ in which the grooves 11 are formed may be set to values different from each other between the upper portion and the lower portion of the imaginary surface 113.

MODIFIED EXAMPLE

Figure 12:
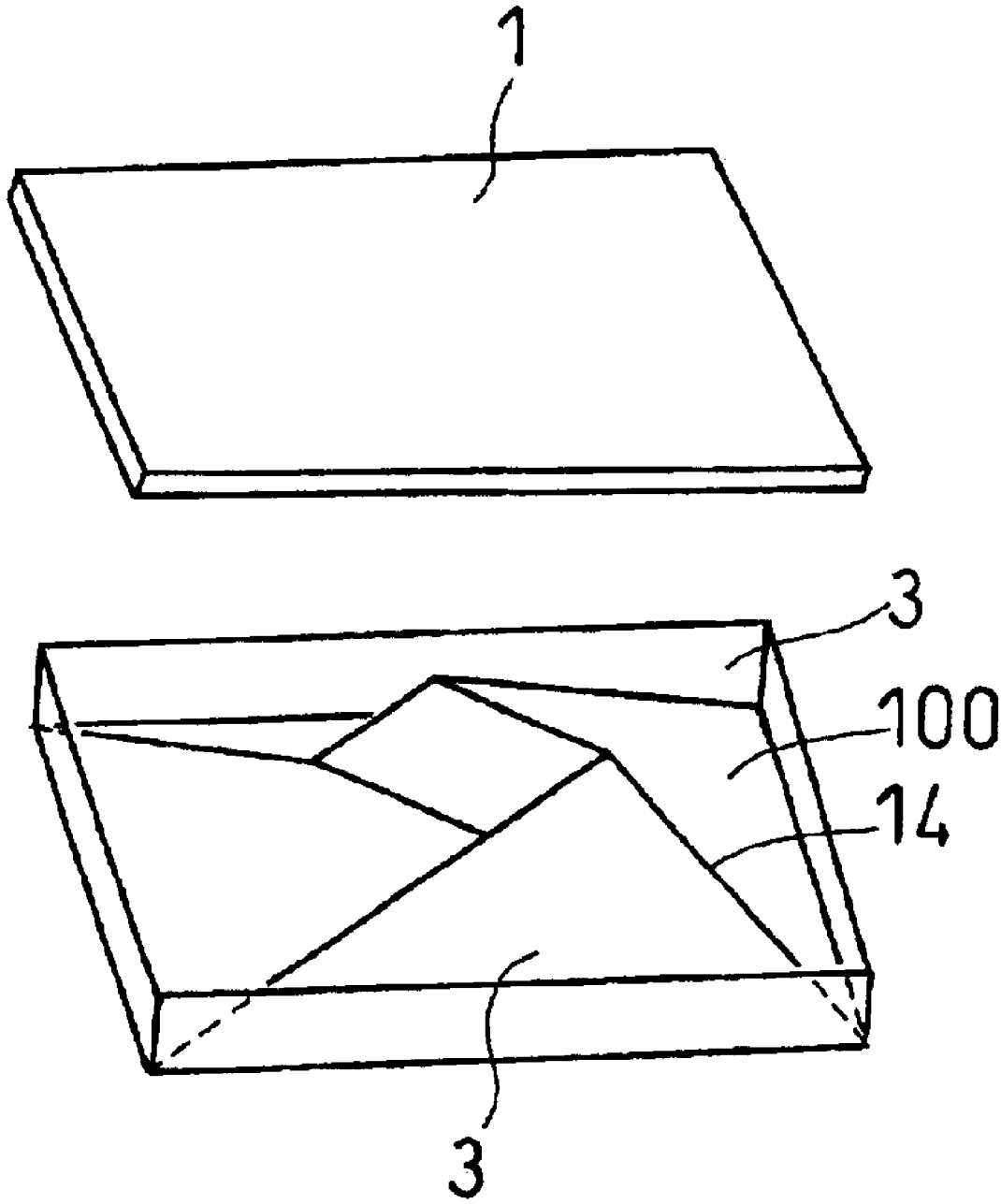
FIG. 12 is a perspective view showing a cushioning structure of another midsole.
Figure 13A:
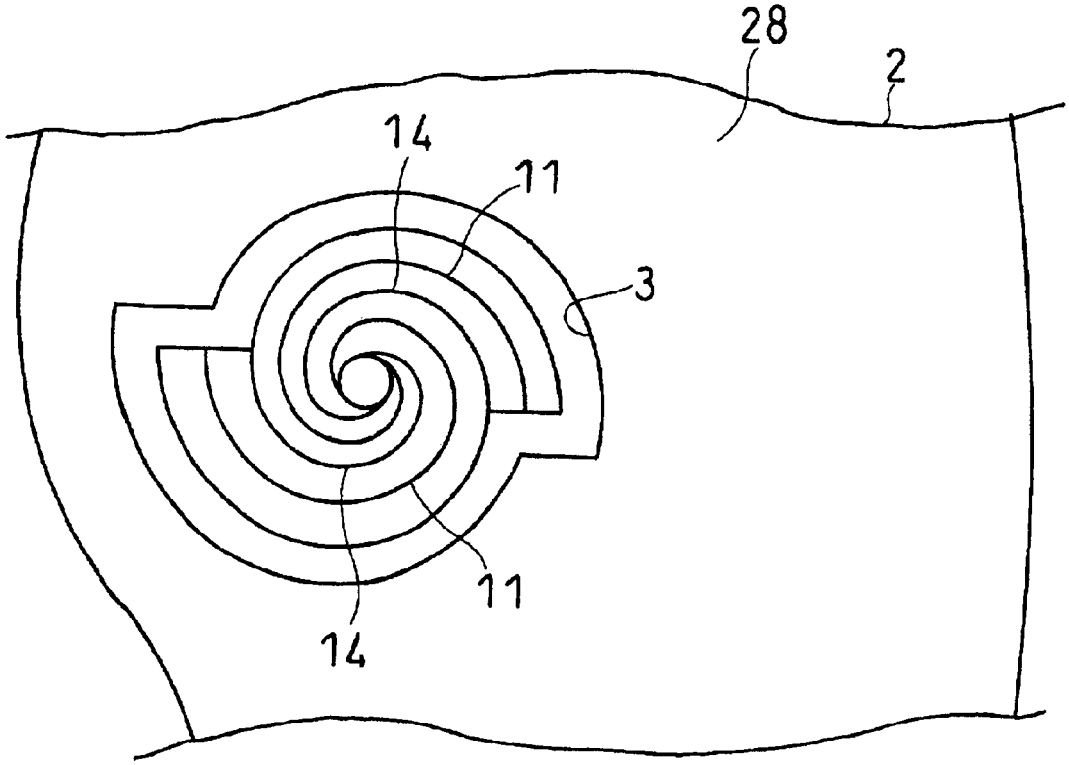
FIG. 13(*a*) and FIG. 13(*b*) are plan views of part of a midsole and a cushioning part, respectively showing still another example.
Figure 13B:
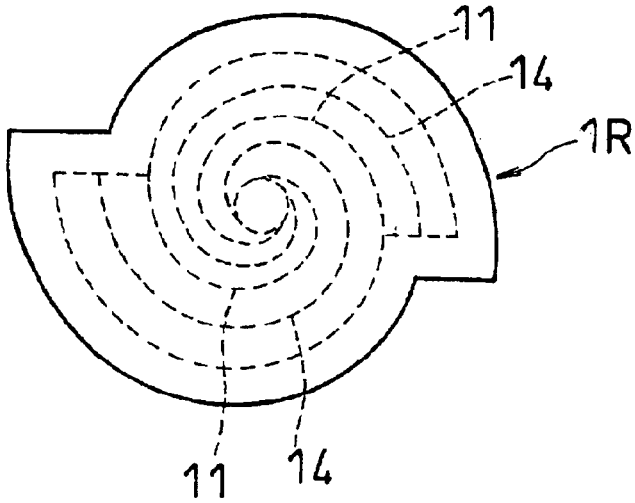

FIG. 12 and FIG. 13 show modified examples.

As shown in FIG. 12, only the convex portion 14 may be provided in the cavity 3 of the midsole.

Besides, as shown in FIGS. 13(*a*) and 13(*b*), the groove 11 and the convex portion 14 may be provided on both the cavity 3 and the cushioning part 1R. Besides, the cushioning part 1R may be constructed by the cap itself.

Fifth Embodiment

Figure 14A:
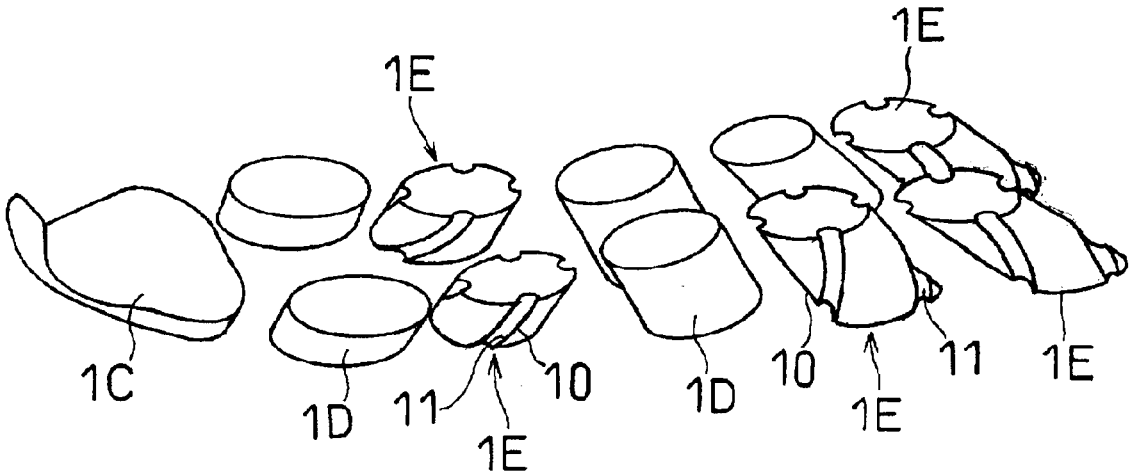
FIG. 14(*a*) is a perspective view showing a midsole of a fifth embodiment, and FIG. 14(*b*) is a perspective view showing a modified example of a cushioning part.
Figure 14B:
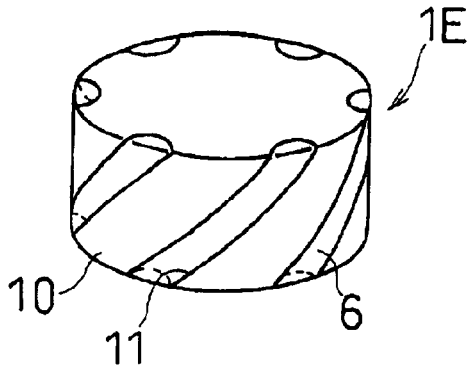
Figure 15A:
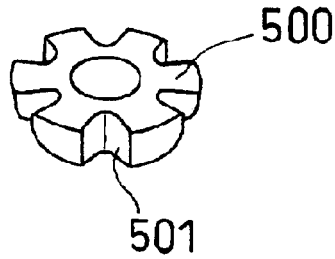
FIG.15(a) PRIOR ART
FIGS. 15(*a*) to 15(*c*) are perspective views and a sectional view showing a conventional cushioning structure.
Figure 15B:
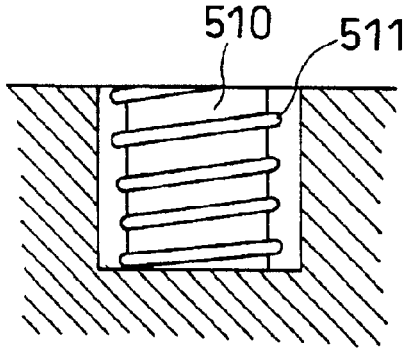
FIG.15(b) PRIOR ART
Figure 15C:
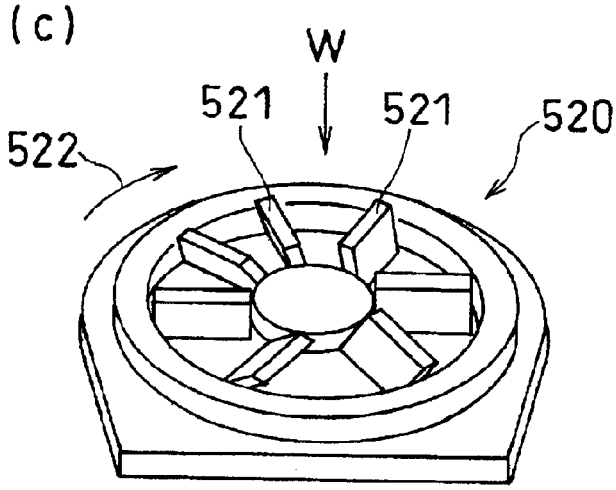
PRIOR ART FIG.15(c)
Figure 16A:
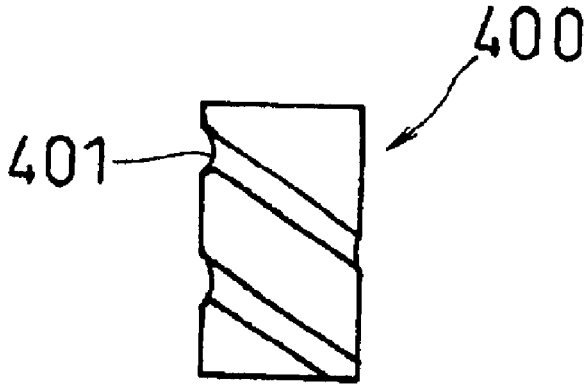
FIG. 16(a) PRIOR ART
FIG. 16(*a*) is a front view showing another conventional cushioning structure, and FIG. 16(*b*) is a plan view of the same.
Figure 16B:
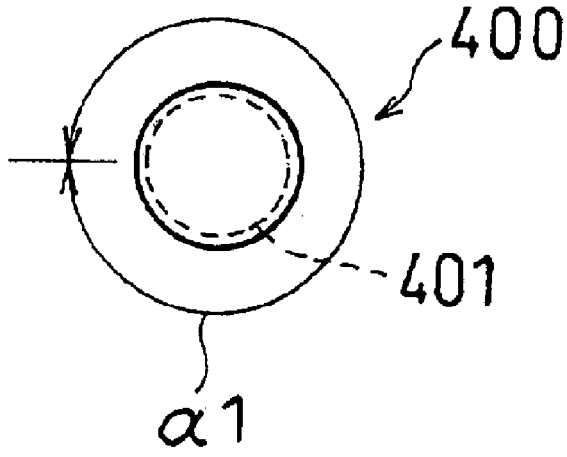
FIG. 16(b) PRIOR ART

FIG. 14(*a*) shows a fifth embodiment.

A midsole 2 is composed of many cushioning parts (cushioning portions) 1C, 1D and 1E. Among these parts, a helical groove 11 is formed on an outer peripheral surface 10 of the cushioning part 1E. The cushioning part 1E is made of a foam of EVA, and is formed to be cylindrical.

The many cushioning parts 1C, 1D and 1E are bonded to an outer sole, cup insole, and the like (not shown) to form an integral shoe sole. Incidentally the upper or lower portions of the respective cushioning parts 1C, 1D and 1E may be integrally coupled at the time of molding. Besides, the cushioning part 1E may be provided only in part of the midsole the whole of which is plate-shaped.

The same structure as the first embodiment can be adopted for the other construction of the cushioning part 1E provided with the groove 11.

Incidentally, in the case where the hardness of the cushioning part 1E is high, the range a and the rotation angle $\beta$ of FIG. 5(*b*) can be made large. For example, in the case where EVA or the like having higher hardness than gel is adopted, the range $\alpha$ can be set within the range of 15 degrees to 180 degrees, and in this case, the rotation angle $\beta$ is generally set to about 5 degrees to 150 degrees.

However, in order to make the shear deformation easily occur irrespective of the hardness of the cushioning part or the cushioning portion, it is preferable that the range $\alpha$ is set within the range of 15 degrees to 120 degrees, and in this case, the rotation angle $\beta$ is generally set to about 5 degrees to 90 degrees. Besides, it is more preferable that the range $\alpha$ is set to the range of 15 degrees to 90 degrees, and in this case, the rotation angle $\beta$ is generally set to about 5 degrees to 60 degrees.

MODIFIED EXAMPLE

As shown in FIG. 14(*b*), in the cushioning part 1E, a soft material 6 such as a gel having Young modulus smaller than a material of the cushioning part 1E, or a material such as a resin having Young modulus larger than the material of the cushioning part 1E may be buried in the groove 11.

As described above, although the preferred embodiments have been described with reference to the drawings, one of ordinary skill in the art could conceive various modifications and corrections within an obvious range by referring to the present specification.

For example, the column may be a square column or a rectangular shell column, not a cylinder or a ring.

Besides, the cushioning part 1E of FIG. 14(*a*) may be integrally formed with the midsole body.

Accordingly, the modifications and corrections as stated above are interpreted as included within the range of the invention determined from the claims.

What is claimed is:

1. A midsole including a cushioning structure, which is provided between an outer sole and an upper and is suitable for absorbing a shock of landing, comprising:

a midsole body defining a cavity; and a cushioning part fitted in the cavity, wherein:

the cushioning part is formed of elastomer;

Young modulus of a member constituting the cushioning part is set to be a value smaller than Young modulus of a member constituting the midsole body;

the cushioning part includes a through hole passing through the cushioning part from its upper surface to its lower surface, whereby the cushioning part is formed into a ring shape having an outer peripheral surface and an inner peripheral surface;

a plurality of first grooves is formed on the outer peripheral surface of the cushioning part;

a plurality of second grooves is helically formed on the inner peripheral surface of the cushioning part;

the respective first grooves are helically formed around a substantially vertical axial line;

the respective first grooves are arranged substantially parallel with each other; and a range in which each of the grooves is formed is larger than a range of 15 degrees around the axial line and smaller than a range of 180 degrees around the axial line.

2. A midsole including a cushioning structure, which is provided between an outer sole and an upper and is suitable for absorbing a shock of landing, comprising:

a midsole body defining a cavity; and a cushioning part fitted in the cavity, wherein:

the cushioning part is formed of elastomer;

Young modulus of a member constituting the cushioning part is set to be a value smaller than Young modulus of a member constituting the midsole body;

the cushioning part includes a through hole passing through the cushioning part from its upper surface to its lower surface, whereby the cushioning part is formed into a ring shape having an outer peripheral surface and an inner peripheral surface;

a plurality of grooves is helically formed on the outer peripheral surface of the cushioning part, the grooves being arranged substantially parallel with each other; and a plurality of grooves is helically formed on the inner peripheral surface of the cushioning part, the grooves being arranged substantially parallel with each other.

3. A midsole including a cushioning structure according to claim 2, wherein the grooves formed on the outer peripheral surface and the grooves formed on the inner peripheral surface are arranged so that when compression load is applied to the cushioning part in a vertical direction, a rotating force is generated to twist the cushioning part around a substantially vertical axial line in one direction.

4. A midsole including a cushioning structure according to claim 3, wherein at least one of the outer peripheral surface and the inner peripheral surface of the cushioning part is formed to be taper-shaped.

5. A midsole including a cushioning structure according to claim 4, wherein the grooves are formed to be continuous from an upper end of the cushioning part to a lower end of the cushioning part.

6. A midsole including a cushioning structure, which is provided between an outer sole and an upper and is suitable for absorbing a shock of landing, comprising:

a midsole body defining a cavity; and a cushioning part fitted in the cavity, wherein:

the cushioning part is formed of elastomer;

Young modulus of a member constituting the part is set to be a value smaller than Young modulus of a member constituting the midsole body;

the cushioning part includes an upper surface and a lower surface;

the midsole body includes a support surface for supporting the lower surface of the cushioning part in the cavity;

a plurality of helical convex portions biting into the lower surface of the cushioning part, and/or a plurality of helical grooves Into which part of the lower surface of the cushioning part is deformed to be embedded, are/is formed on the support surface; and when compression load is applied to the cushioning part in a vertical direction, the convex portions and/or the grooves generate a rotating force to twist the cushioning part around a substantially vertical axial line.

7. A midsole including a cushioning structure according to claim 6, further comprising:

a cap arranged over the cushioning part and closing the cavity, wherein:

a lower surface of the cap is in contact with the upper surface of the cushioning part; and at least one of a plurality of helical convex portions biting into the upper surface of the cushioning part and a plurality of helical grooves into which part of the upper surface of the cushioning part is deformed to be embedded, is formed on the lower surface of the cap.

* * * * *